US009024216B2

(12) United States Patent
Turner et al.

(10) Patent No.: US 9,024,216 B2
(45) Date of Patent: May 5, 2015

(54) ELECTRICAL SWITCHING APPARATUS INCLUDING OPERATING HANDLE WITH DAMPENING MEMBER

(71) Applicant: Eaton Corporation, Cleveland, OH (US)

(72) Inventors: David C. Turner, Imperial, PA (US); John E. Devine, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 142 days.

(21) Appl. No.: 13/916,781

(22) Filed: Jun. 13, 2013

(65) Prior Publication Data

US 2014/0367235 A1 Dec. 18, 2014

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |
| ***H01H 3/60*** | (2006.01) |
| ***H01H 71/52*** | (2006.01) |

(52) U.S. Cl.

CPC . *H01H 9/02* (2013.01); *H01H 9/06* (2013.01); *H01H 3/60* (2013.01); *H01H 71/521* (2013.01)

(58) Field of Classification Search

CPC ... H01H 69/00; H01H 71/02; H01H 71/0221; H01H 71/0264; H01H 71/10; H01H 71/2463; H01H 71/521; H01H 71/522; H01H 71/523; H01H 71/524; H01H 71/54; H01H 73/00; H01H 73/06; H01H 75/00; H01H 77/00; H01H 79/00; H01H 81/00

USPC ..... 200/293

See application file for complete search history.

(56) References Cited

U.S. PATENT DOCUMENTS

| | | | |
|---|---|---|---|
| 1,940,716 | A | 12/1933 | Hubbell, Jr. |
| 4,626,811 | A | 12/1986 | McKee et al. |
| 5,027,095 | A | 6/1991 | McKay et al. |
| 6,420,669 | B1 | 7/2002 | Shenker et al. |
| 7,023,303 | B1 | 4/2006 | Bogdon et al. |

OTHER PUBLICATIONS

European Patent Office, "International Search Report and Written Opinion", Jul. 9, 2014, 13 pp.

*Primary Examiner* — Edwin A. Leon
*Assistant Examiner* — Anthony R. Jimenez
(74) *Attorney, Agent, or Firm* — Eckert Seamans Cherin & Mellott, LLC; John P. Powers; Kirk D. Houser

(57) ABSTRACT

An electrical switching apparatus includes a housing having an interior and an opening, separable contacts, and an operating mechanism structured to open and close the separable contacts. The operating mechanism includes an operating handle extending from the interior of the housing and through the opening of the housing. A dampening member is disposed on the operating handle. The dampening member is structured to engage the housing at the opening thereof when the operating handle moves to at least one of an "ON" position and a "RESET" or "OFF" position.

18 Claims, 3 Drawing Sheets

ELECTRICAL SWITCHING APPARATUS INCLUDING OPERATING HANDLE WITH DAMPENING MEMBER

BACKGROUND

1. Field

The disclosed concept pertains generally to electrical switching apparatus and, more particularly, to electrical switching apparatus, such as, for example, circuit interrupters, which include an operating handle.

2. Background Information

Electrical switching apparatus, such as circuit interrupters, provide protection for electrical systems from electrical fault conditions such as, for example and without limitation, current overloads, short circuits, abnormal voltage and other fault conditions. Typically, circuit interrupters include an operating mechanism which opens a number of electrical contact assemblies to interrupt the flow of current through the conductors of an electrical system in response to such fault conditions as detected, for example, by a trip mechanism, such as a trip unit.

Circuit interrupters, such as circuit breakers, are generally old and well known in the art. Circuit breakers include, for example, at least one set of separable contacts disposed within a non-conductive housing. Typically, there is a fixed contact coupled to the housing and a movable contact coupled to the operating mechanism. The operating mechanism includes a movable operating handle that extends outside of the housing. Movement of the separable contacts is accomplished by the operating mechanism.

In some areas of use, the operating handle of a molded case circuit breaker gets pushed relatively hard by a user when switched to an "ON" position or to a "RESET" or "OFF" position than was intended. This occurs when the user toggles the operating handle with excessive force and it goes beyond the toggle position. The additional force at the end of toggle travel of the operating handle creates a relatively high impact loading when the operating handle reaches the travel limit, which typically is the top of the cover of the molded case. This is a dead stop to the cycling of the operating handle. The impact force is such that the plastic molded handle yields to the impact forces and the operating handle can fail mechanically.

There is room for improvement in electrical switching apparatus, such as, for example, circuit interrupters, which include an operating handle.

SUMMARY

These needs and others are met by embodiments of the disclosed concept in which a dampening member is structured to engage an electrical switching apparatus housing at an opening thereof when an operating handle moves to at least one of an "ON" position and a "RESET" or "OFF" position.

In accordance with one aspect of the disclosed concept, an electrical switching apparatus comprises: a housing including an interior and an opening; separable contacts; an operating mechanism structured to open and close the separable contacts, the operating mechanism including an operating handle extending from the interior of the housing and through the opening of the housing; and a dampening member disposed on the operating handle, the dampening member being structured to engage the housing at the opening thereof when the operating handle moves to at least one of an "ON" position and a "RESET" or "OFF" position.

As another aspect of the disclosed concept, a circuit interrupter comprises: a housing including an interior and an opening; separable contacts; an operating mechanism structured to open and close the separable contacts, the operating mechanism including an operating handle extending from the interior of the housing and through the opening of the housing; and an elastic dampening member disposed on the operating handle, the elastic dampening member being structured to engage the housing at the opening thereof when the operating handle moves to at least one of an "ON" position and a "RESET" or "OFF" position.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "dampening" and variations thereof shall mean reducing, checking, diminishing or absorbing the activity, vigor, force or loading of impact, contact or engagement between a housing of an electrical switching apparatus and an operating handle thereof.

As employed herein, the statement that two or more parts are "connected" or "coupled" together shall mean that the parts are joined together either directly or joined through one or more intermediate parts.

The disclosed concept is described in association with a circuit breaker, although the disclosed concept is applicable to a wide range of electrical switching apparatus, which include an operating handle.

Figure 1:
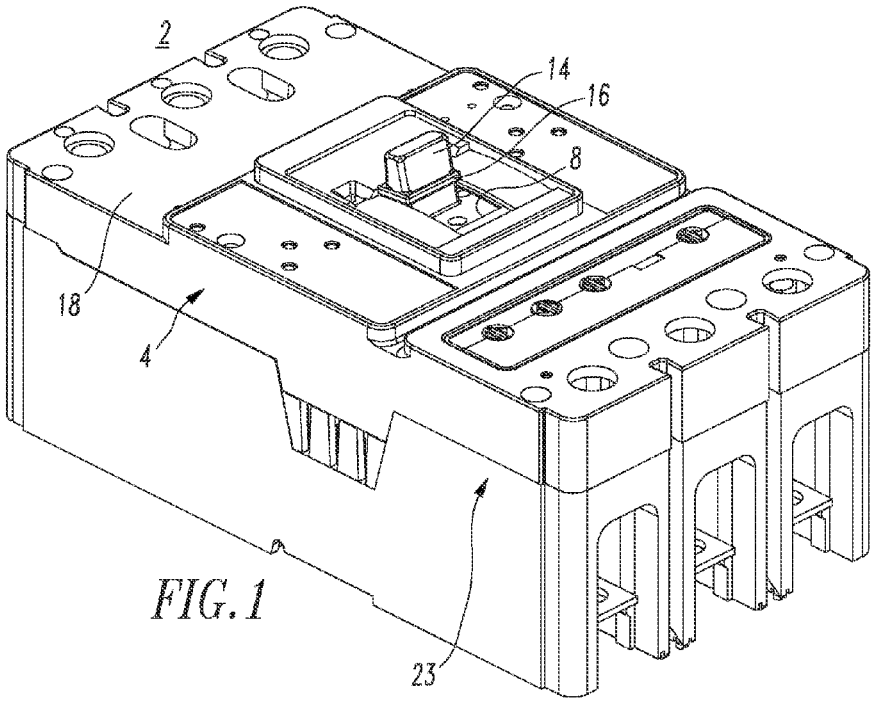
FIG. 1 is an isometric view of a circuit breaker in an "ON" position in accordance with embodiments of the disclosed concept.
Figure 2:
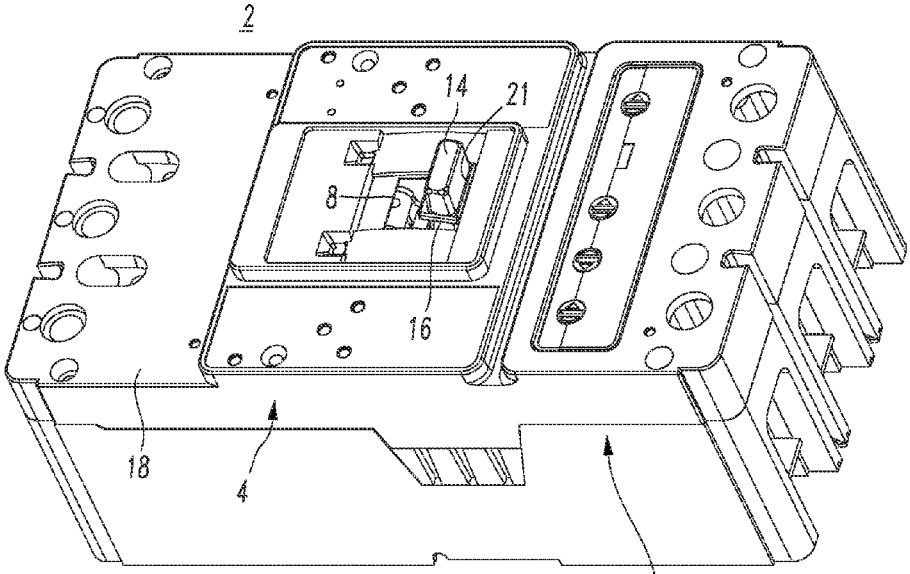
FIG. 2 is an isometric view of the circuit breaker of FIG. 1 in a "RESET" or "OFF" position.
Figure 3:
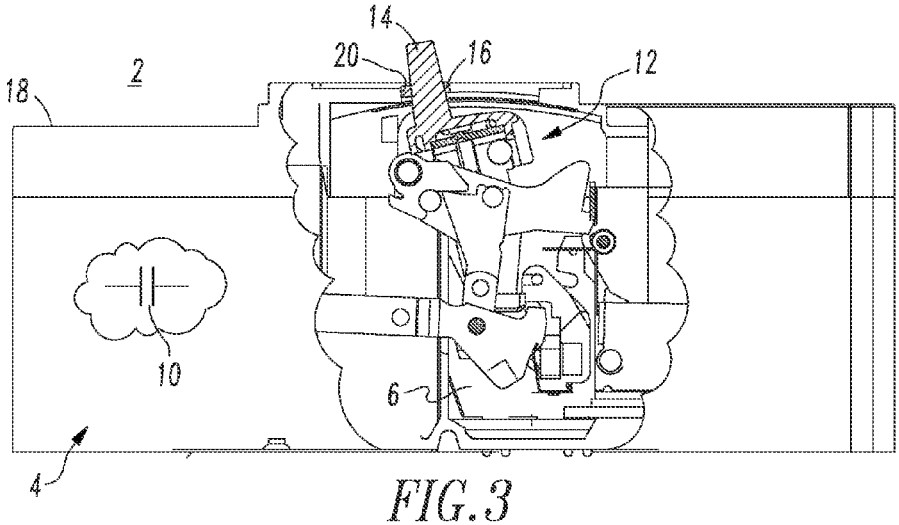
FIGS. 3 and 4 are vertical elevation views of the circuit breakers of FIGS. 1 and 2, respectively, with some parts cut away to show internal structures.
Figure 4:
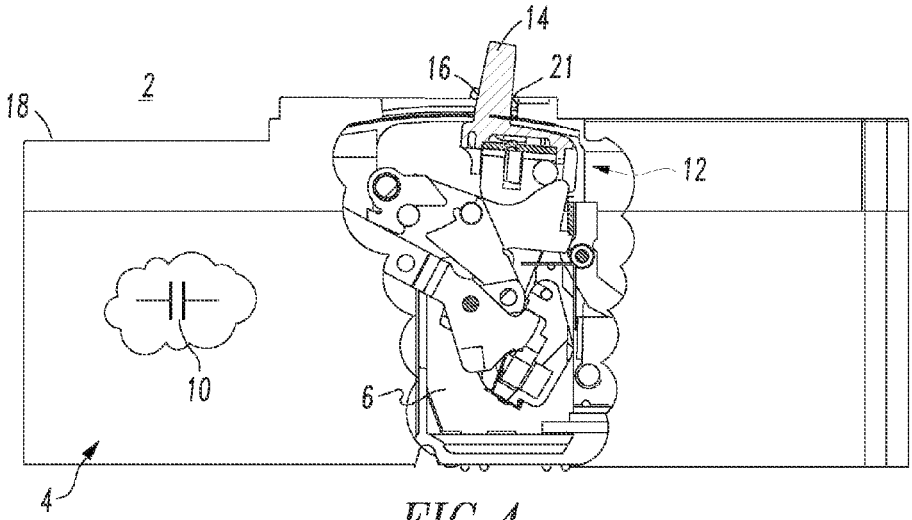

Referring to FIGS. 1-4, an electrical switching apparatus 2 (e.g., without limitation, a circuit interrupter, such as the example molded case circuit breaker) includes a housing 4 having an interior 6 and an opening 8, separable contacts 10 (shown in block form in FIGS. 3 and 4), and an operating mechanism 12 structured to open and close the separable contacts 10. The operating mechanism 12 includes an operating handle 14 extending from the housing interior 6 and through the opening 8. A dampening member 16 is disposed on the operating handle 14 and is structured to engage the housing 4 at the opening 8 thereof when the operating handle 14 moves to at least one of an "ON" position (FIGS. 1 and 3) and a "RESET" or "OFF" position (FIGS. 2 and 4). In this example, the dampening member 16 engages the housing 4 at the opening 8 thereof in each of those positions.

FIGS. 1 and 3, and FIGS. 2 and 4, show the extreme positions of the operating handle 14 in the "ON" position, and the "RESET" or "OFF" position, respectively. A "TRIP" position (not shown) of the operating handle 14 is a position of travel between the two extreme positions, although the disclosed concept is applicable to electrical switching apparatus that do not include a "TRIP" position. Also, some electrical switching apparatus do not include a "RESET" position, while other electrical switching apparatus include an "OFF" position that is slightly offset from an extreme "RESET" position.

The dampening member 16 is structured to engage the housing 4 at the opening 8 thereof in order to reduce impact loading to the operating handle 14 by absorbing impact force when the dampening member 16 impacts the housing 4. The housing 4 further includes a cover 18 defining a predetermined travel stop 20 or 21 of the operating handle 14. As the operating handle 14 approaches the predetermined travel stop 20 (FIG. 3) or 21 (FIGS. 2 and 4), the dampening member 16 first makes contact with the predetermined travel stop 20 or 21 and dampens an impact load to the operating handle 14.

The dampening member 16 increases a time it takes for the operating handle 14 to reach a dead stop at or about the predetermined travel stop 20 or 21.

The dampening member 16 is structured to have no effect on switching of the separable contacts 10 by the operating mechanism 12.

Figure 5:
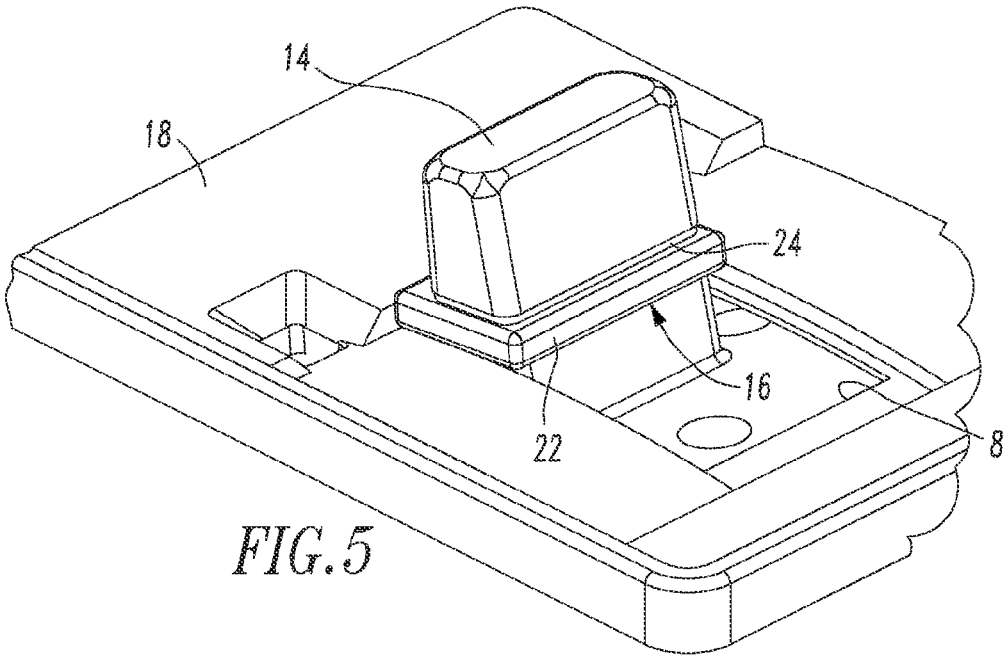
FIG. 5 is an isometric view of the operating handle, dampening member and opening of FIG. 1.

Referring to FIG. 5, the operating handle 14, the dampening member 16 and the housing opening 8 of FIG. 1 are shown. Preferably, a suitable elastic dampening member, such as an example elastic polymer ring 22, is made of a suitable shock absorbing material that also has relatively high temperature and dielectric strength characteristics. A non-limiting example material is a Sorbothane® visco-elastic polymer. The example elastic polymer ring 22 reduces the impact loading to the operating handle 14 by absorbing the impact force. This addition of the example elastic polymer ring 22 has no effect on the internal portion of the operating mechanism 12 or the switching of the circuit breaker separable contacts 10.

The disclosed example operating handle 14 includes the example elastic polymer ring 22 disposed thereon at or about the external portion of the base of the handle 14. This provides a dampening effect when the ring 22 impacts the circuit breaker housing 4, such as the cover 18 (FIGS. 1 and 2) of a molded case 23 (FIGS. 1 and 2). As the handle 14 approaches the predetermined travel stop 20 (FIG. 3), the ring 22 first makes contact and dampens the impact load, thereby preventing damage to the handle 14, which is made, for example and without limitation, of plastic. The ring 22 is structured to engage the housing 4 at the opening 8 thereof in order to provide a dampening effect when the elastic polymer ring 22 impacts the housing 4.

As can be seen in FIG. 5, the operating handle 14 includes a number of notches 24 (in this example, one circular notch 24 is shown about the operating handle 14) to contain the elastic polymer ring 22. The elastic polymer ring 22 is contained on the operating handle 14 by tension of the ring 22 and is held in place by the example notch 24. For example, the notch 24 is proximate the housing opening 8 and is structured to hold and contain the elastic polymer ring 22.

Alternatively, the operating handle 14 is a molded member with a suitable notch geometry in order to hold and contain the example elastic polymer ring 22 or another suitable dampening member (not shown).

Figure 6:
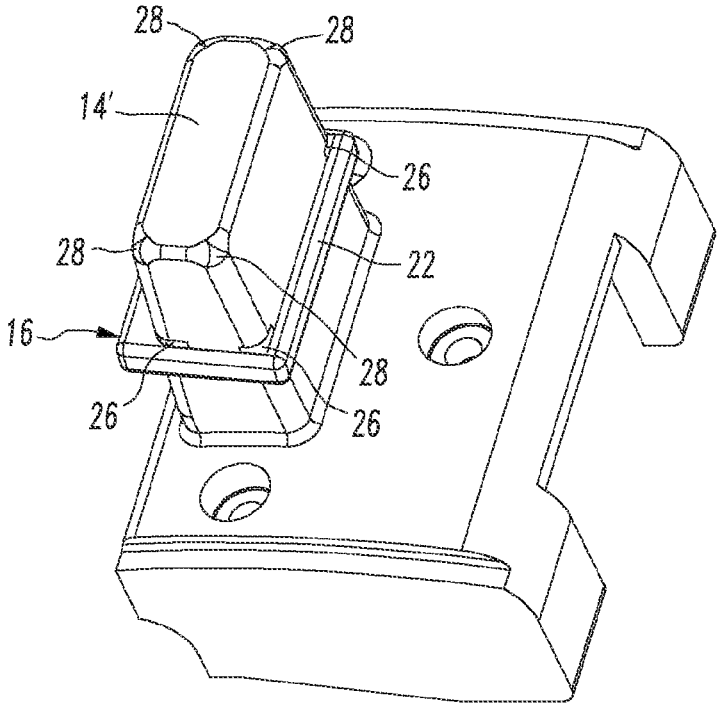
FIG. 6 is an isometric view of an operating handle and dampening member in accordance with another embodiment of the disclosed concept.

FIG. 6 shows another operating handle 14' and the dampening member 16 of FIG. 1. In this example, a conventional operating handle (not shown) can be modified such that the example elastic polymer ring 22 is inserted and contained at or about the external portion of the base of the handle 14'. For example, notches 26 can be added to the handle 14 at each of the corners 28 as a secondary operation following the molding of the handle 14'. The elastic polymer ring 22 is contained on the handle 14' by tension of the polymer ring 22 and is held in place by the example fitted notches 26. In this example, the operating handle 14' is modified with the notches 26 proximate the housing opening 8 (FIGS. 1 and 3). The notches 26 are structured to hold and contain the ring 22. Here, the molded operating handle 14' includes four corners 28, and four of the notches 26 are included on the molded operating handle, one of the four notches 26 at each of the four corners 28.

The disclosed electrical switching apparatus 2 includes a suitable circuit interrupter mechanism, such as the separable contacts 10 that are opened and closed by the operating mechanism 12, although the disclosed concept is applicable to a wide range of circuit interruption mechanisms (e.g., without limitation, contactor or switch contacts) and/or operating mechanisms (e.g., without limitation, electro-mechanical or mechanical mechanisms).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:

a housing including an interior and an opening;

separable contacts;

an operating mechanism structured to open and close said separable contacts, said operating mechanism including an operating handle extending from the interior of said housing and through the opening of said housing; and a dampening member disposed on said operating handle, said dampening member being structured to engage said housing at the opening thereof when said operating handle moves to at least one of an "ON" position and a "RESET" or "OFF" position;

wherein said dampening member is a ring separately disposed on said operating handle; and wherein said operating handle extends through said ring.

2. The electrical switching apparatus of claim 1 wherein said electrical switching apparatus is a circuit interrupter.

3. The electrical switching apparatus of claim 1 wherein said electrical switching apparatus is a molded case circuit breaker.

4. The electrical switching apparatus of claim 1 wherein said ring is structured to engage said housing at the opening thereof when said operating handle moves to said "ON" position and when said operating handle moves to said "RESET" or "OFF" position.

5. The electrical switching apparatus of claim 1 wherein said ring is an elastic polymer ring.

6. The electrical switching apparatus of claim 5 wherein said elastic polymer ring is structured to engage said housing at the opening thereof in order to provide a dampening effect when said elastic polymer ring impacts said housing.

7. The electrical switching apparatus of claim 5 wherein said operating handle includes a number of notches to contain said elastic polymer ring.

8. The electrical switching apparatus of claim 7 wherein said number of notches comprises a circular notch; wherein said elastic polymer ring is contained on said operating handle by tension of said elastic polymer ring and is held in place by said circular notch; and wherein said elastic polymer ring does not extend through said circular notch.

9. The electrical switching apparatus of claim 7 wherein said operating handle is a molded member with a notch proximate the opening of said housing, said notch being structured to hold and contain said elastic polymer ring.

10. The electrical switching apparatus of claim 1 wherein said ring is structured to engage said housing at the opening thereof in order to reduce impact loading to said operating handle by absorbing impact force when said ring impacts said housing.

11. The electrical switching apparatus of claim 1 wherein said housing further includes a cover defining a predetermined travel stop of said operating handle; and wherein as said operating handle approaches the predetermined travel stop, said ring first makes contact with said predetermined travel stop and dampens an impact load to said operating handle.

12. The electrical switching apparatus of claim 11 wherein said ring increases a time it takes for said operating handle to reach a dead stop at or about the predetermined travel stop.

13. The electrical switching apparatus of claim 1 wherein said ring is structured to have no effect on switching of said separable contacts by said operating mechanism.

14. The electrical switching apparatus of claim 1 wherein said operating handle is modified with a plurality of notches proximate the opening of said housing; wherein said notches are structured to hold and contain said ring; and wherein said ring engages each of said notches.

15. The electrical switching apparatus of claim 14 wherein said operating handle is a molded operating handle including four corners; and wherein four of said notches are included on said molded operating handle, one of said four notches at each of said four corners.

16. The electrical switching apparatus of claim 1 wherein said ring is made of a shock absorbing material.

17. The electrical switching apparatus of claim 1 wherein said ring is made of a visco-elastic polymer.

18. A circuit interrupter comprising:

a housing including an interior and an opening;

separable contacts; an operating mechanism structured to open and close said separable contacts, said operating mechanism including an operating handle extending from the interior of said housing and through the opening of said housing; and an elastic dampening member disposed on said operating handle, said elastic dampening member being structured to engage said housing at the opening thereof when said operating handle moves to at least one of an "ON" position and a "RESET" or "OFF" position;

wherein said elastic dampening member is an elastic ring separately disposed on said operating handle; and wherein said operating handle extends through said elastic ring.

* * * * *